US006378210B1

(12) United States Patent
Bickford

(10) Patent No.: US 6,378,210 B1
(45) Date of Patent: Apr. 30, 2002

(54) PATTERN DESIGNER SHAVER SYSTEM

(76) Inventor: Roy L. Bickford, 255 N. Michigan Bldg. 2, Apt. 6, Lawrence, KS (US) 66044

( * ) Notice: Subject to any disclaimer, the term of this patent is extended or adjusted under 35 U.S.C. 154(b) by 0 days.

(21) Appl. No.: 09/527,338

(22) Filed: Mar. 17, 2000

(51) Int. Cl.[7] ..... B25F 3/00
(52) U.S. Cl. ..... 30/43.92; 30/122; 30/DIG. 2
(58) Field of Search ..... 30/43.92, 34.05, 30/34.1, 122, DIG. 1, DIG. 2, 277.4, 195, 210, 216, 200, 43

(56) References Cited

U.S. PATENT DOCUMENTS 5,058,273 A * 10/1991 Streger ..... 30/277.4
5,060,380 A * 10/1991 Fujikawa ..... 30/200
6,044,558 A * 4/2000 Wu ..... 30/34.1

* cited by examiner

*Primary Examiner*—Hwei-Siu Payer
(74) *Attorney, Agent, or Firm*—Joseph N. Breaux

(57) ABSTRACT

A pattern designer shaver system that includes a base unit for driving a number of user attachable trimmer and shaver accessories of varying widths.

2 Claims, 2 Drawing Sheets

PATTERN DESIGNER SHAVER SYSTEM

TECHNICAL FIELD

The present invention relates to grooming tools and more particularly to a pattern designer shaver system that includes a battery powered base unit, a half inch width and a quarter inch thick shaver attachment, a half inch width and a quarter inch thick trimmer attachment, and a beard trimmer length gauge attachment; the battery powered base unit including a shaver housing having a battery compartment accessible through a removable end cap; the battery compartment including a battery connector wired in series with an on/off switch and a DC drive motor; the DC drive motor having an off-set output shaft with an attachment coupling end extending out of an attachment fitting end of the shaver housing; the attachment fitting end having externally positioned base unit threads provided thereon; the half inch width and a quarter inch thick shaver attachment including a shaver head couplable to the off-set output shaft by an attachment slot formed into the bottom of the shaver head and a shaver attachment housing having an internally threaded base unit coupling end having internal shaver attachment threads that are companionate with the base unit threads; the half inch width and a quarter inch thick trimmer attachment including a trimmer assembly couplable to the off-set output shaft by an attachment slot formed into the bottom of the trimmer assembly and a trimmer attachment housing having an internally threaded base unit coupling end having internal trimmer attachment threads that are companionate with the base unit threads; an exterior surface of the trimmer attachment housing having ridges extending outwardly therefrom for retaining the beard trimmer length gauge attachment when it is snap fit over the trimmer attachment housing; the beard trimmer length gauge having a gauge housing having a number of hair passage slots provided at a face contact end and an open trimmer coupling end sized and shaped to snap fit over the trimmer attachment housing.

BACKGROUND ART

Many individuals enjoy creating complex patterns by trimming and shaving patterns into their facial hair. It would be a benefit, to these individuals to have a pattern designer shaver system that included a base unit for driving a number of trimmer and shaver accessories of varying widths.

GENERAL SUMMARY DISCUSSION OF INVENTION

It is thus an object of the invention to provide a pattern designer shaver system that includes a battery powered base unit, a half inch width and a quarter inch thick shaver attachment, a half inch width and a quarter inch thick trimmer attachment, and a beard trimmer length gauge attachment; the battery powered base unit including a shaver housing having a battery compartment accessible through a removable end cap; the battery compartment including a battery connector wired in series with an on/off switch and a DC drive motor; the DC drive motor having an off-set output shaft with an attachment coupling end extending out of an attachment fitting end of the shaver housing; the attachment fitting end having externally positioned base unit threads provided thereon; the half inch width and a quarter inch thick shaver attachment including a shaver head couplable to the off-set output shaft by an attachment slot formed into the bottom of the shaver head and a shaver attachment housing having an internally threaded base unit coupling end having internal shaver attachment threads that are companionate with the base unit threads; the half inch width and a quarter inch thick trimmer attachment including a trimmer assembly couplable to the off-set output shaft by an attachment slot formed into the bottom of the trimmer assembly and a trimmer attachment housing having an internally threaded base unit coupling end having internal trimmer attachment threads that are companionate with the base unit threads; an exterior surface of the trimmer attachment housing having ridges extending outwardly therefrom for retaining the beard trimmer length gauge attachment when it is snap fit over the trimmer attachment housing; the beard trimmer length gauge having a gauge housing having a number of hair passage slots provided at a face contact end and an open trimmer coupling end sized and shaped to snap fit over the trimmer attachment housing.

Accordingly, a pattern designer shaver system is provided. The pattern designer shaver system includes a battery powered base unit, a half inch width and a quarter inch thick shaver attachment, a half inch width and a quarter inch thick trimmer attachment, and a beard trimmer length gauge attachment; the battery powered base unit including a shaver housing having a battery compartment accessible through a removable end cap; the battery compartment including a battery connector wired in series with an on/off switch and a DC drive motor; the DC drive motor having an off-set output shaft with an attachment coupling end extending out of an attachment fitting end of the shaver housing; the attachment fitting end having externally positioned base unit threads provided thereon; the half inch width and a quarter inch thick shaver attachment including a shaver head couplable to the off-set output shaft by an attachment slot formed into the bottom of the shaver head and a shaver attachment housing having an internally threaded base unit coupling end having internal shaver attachment threads that are companionate with the base unit threads; the half inch width and a quarter inch thick trimmer attachment including a trimmer assembly couplable to the off-set output shaft by an attachment slot formed into the bottom of the trimmer assembly and a trimmer attachment housing having an internally threaded base unit coupling end having internal trimmer attachment threads that are companionate with the base unit threads; an exterior surface of the trimmer attachment housing having ridges extending outwardly therefrom for retaining the beard trimmer length gauge attachment when it is snap fit over the trimmer attachment housing; the beard trimmer length gauge having a gauge housing having a number of hair passage slots provided at a face contact end and an open trimmer coupling end sized and shaped to snap fit over the trimmer attachment housing.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
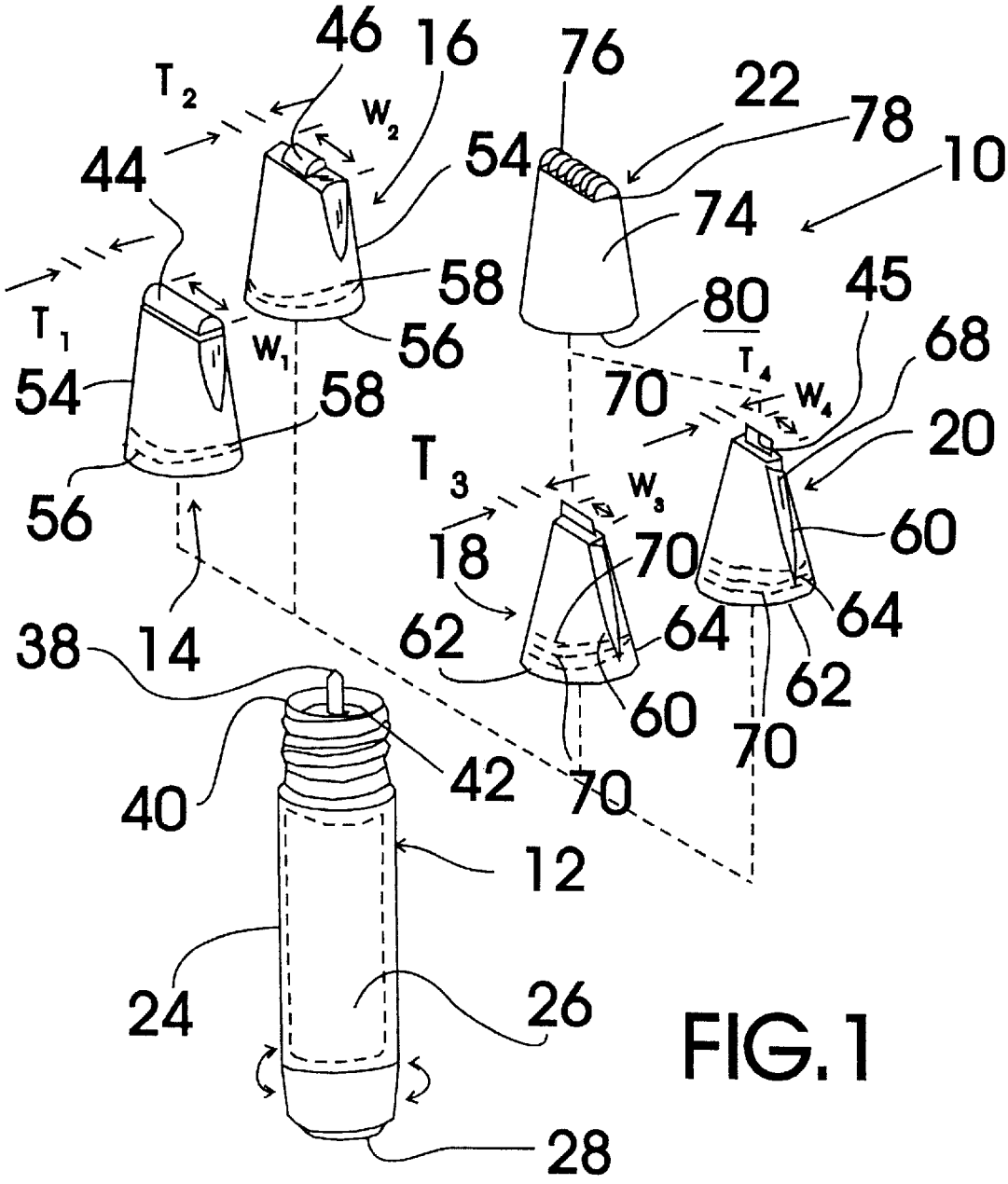
FIG. 1 is a perspective view of an exemplary embodiment of the pattern designer shaver system of the present invention showing the battery powered base unit, a half inch width and a quarter inch thick shaver attachment, a quarter inch width and a quarter inch thick shaver attachment, a half inch width and a quarter inch thick trimmer attachment, a quarter inch width and a quarter inch thick trimmer attachment, and a beard trimmer length gauge attachment; the battery powered base unit including a shaver housing having a battery compartment accessible through a removable end cap; the battery compartment including a battery connector wired in series with an on/off switch and a DC drive motor; the DC drive motor having an off-set output shaft with an attachment coupling end extending out of an attachment fitting end of the shaver housing; the attachment fitting end having externally positioned base unit threads provided thereon; each of the shaver attachments including a shaver head couplable to the off-set output shaft by an attachment slot formed into the bottom of the shaver head and a shaver attachment housing having an internally threaded base unit coupling end having internal shaver attachment threads that are companionate with the base unit threads; each of the trimmer attachments including a trimmer assembly couplable to the off-set output shaft by an attachment slot formed into the bottom of the trimmer assembly and a trimmer attachment housing having an internally threaded base unit coupling end having internal trimmer attachment threads that are companionate with the base unit threads; an exterior surface of the trimmer attachment housing having ridges extending outwardly therefrom for retaining the beard trimmer length gauge attachment when it is snap fit over the trimmer attachment housing; the beard trimmer length gauge having a gauge housing having a number of hair passage slots provided at a face contact end and an open trimmer coupling end sized and shaped to snap fit over the trimmer attachment housing.
Figure 3:
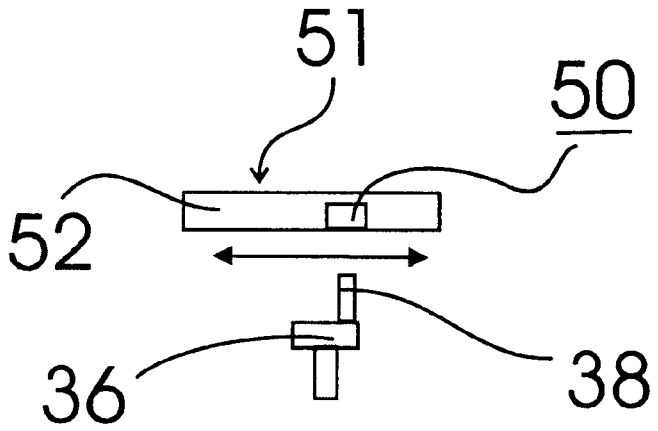
FIG. 3 is a schematic view showing an attachment slot and the off-set output shaft with the attachment coupling end of the DC drive motor.
Figure 2:
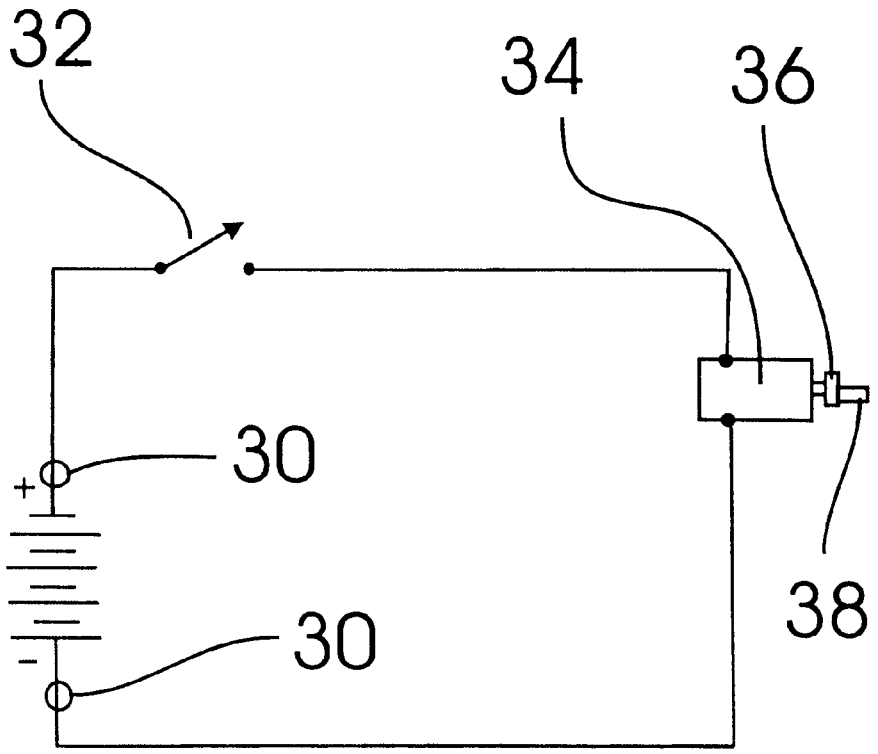
FIG. 2 is a schematic diagram of the electrical connections between the battery connector, the on/off switch and the DC drive motor.

FIGS. 1–3 show various aspects of an exemplary embodiment of the pattern designer shaver system of the present invention generally designated 10. Pattern designer shaver system 10 includes a battery powered base unit, generally designated 12; a half inch width $W_1$ and a quarter inch thick $T_1$ shaver attachment, generally designated 14; a quarter inch width $W_2$ and a quarter inch thick $T_2$ shaver attachment, generally designated 16; a half inch width $W_3$ and a quarter inch thick $T_3$ trimmer attachment, generally designated 18; a quarter inch width $W_4$ and a quarter inch thick $T_4$ trimmer attachment, generally designated 20; and a beard trimmer length gauge attachment, generally designated 22.

Battery powered base unit 12 includes a shaver housing 24 having a battery compartment 26 (shown in dashed lines) that is accessible through a removable end cap 28. Battery compartment 26 includes a battery connector 30 wired in series with an on/off switch 32 and a DC drive motor 34. DC drive motor 34 has an off-set output shaft 36 with an attachment coupling end 38 extending lout of an attachment fitting end 40 of shaver housing 24. Attachment fitting end 40 has externally positioned base unit threads 42 provided thereon.

Half inch width $W_1$ and a quarter inch thick $T_1$ and quarter inch width $W_2$ and a quarter inch thick $T_2$ shaver attachments 14,16 are substantially identical except for the width. Shaver attachments 14,16 each include a shaving blade 51 within the shaving head 44,46 couplable to off-set output shaft 38 by an attachment slot 50 formed into the bottom 52 of shaving blade 51 and a shaver attachment housing 54 having an internally threaded base unit coupling end 56 having internal shaver attachment threads 58 (shown in dashed lines) that are companionate with base unit threads 42.

Half inch width and a quarter inch thick trimmer attachment: 18 and quarter inch width and a quarter inch thick trimmer attachment 20 are substantially identical except for the trimmer width. Each trimmer attachment 18,20 includes a conventional hair trimmer head 45 couplable to the off-set output shaft 36 by an attachment slot 50 formed into the bottom 52 thereof and a trimmer attachment housing 60 having an internally threaded base unit coupling end 62 having internal trimmer attachment threads 64 (shown in dashed lines) that are companionate with the base unit threads 42. An exterior surface 68 of trimmer attachment housing 64 has ridges 70 extending outwardly therefrom for retaining the beard trimmer length gauge attachment 22 when it is snap fit over the trimmer attachment housing 60. Beard trimmer length gauge 22 has a gauge housing 74 having a number of hair passage slots 76 provided at a face contact end 78 and an open trimmer coupling end 80 sized and shaped to snap fit over the trimmer attachment housing 60.

In use, the user simply selects the desired attachment 14,16,18,20 and couples it to base unit 12 to create the desired pattern. It can be seen from the preceding description that a pattern designer shaver system has been provided.

It is noted that the embodiment of the pattern designer shaver system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A pattern designer shaver system comprising:

a battery powered base unit;

a half inch width and a quarter inch thick shaver attachment;

a half inch width and a quarter inch thick trimmer attachment; and a beard trimmer length gauge attachment;

said battery powered base unit including a shaver housing having a battery compartment accessible through a removable end cap;

said battery compartment including a battery connector wired in series with an on/off switch and a DC drive motor;

said DC drive motor having an off-set output shaft with an attachment coupling end extending out of an attachment fitting end of said shaver housing;

said attachment fitting end having externally positioned base unit threads provided thereon;

said half inch width and a quarter inch thick shaver attachment including a shaver head couplable to said off-set output shaft by an attachment slot formed into a bottom of said shaver head and a shaver attachment housing having an internally threaded base unit coupling end having internal shaver attachment threads that are companionate with said base unit threads;

said half inch width and a quarter inch thick trimmer attachment including a trimmer assembly couplable to said off-set output shaft by an attachment slot formed into a bottom of said trimmer assembly and a trimmer attachment housing having an internally threaded base unit coupling end having internal trimmer attachment threads that are companionate with said base unit threads;

an exterior surface of said trimmer attachment housing having ridges extending outwardly therefrom for retaining said beard trimmer length gauge attachment when it is snap fit over said trimmer attachment housing;

said beard trimmer length gauge attachment having a gauge housing having a number of hair passage slots provided at a face contact end and an open trimmer coupling end sized and shaped to snap fit over said trimmer attachment housing.

2. A pattern designer shaver system comprising:

a battery powered base unit;

a half inch width and a quarter inch thick shaver attachment;

a quarter inch width and a quarter inch thick shaver attachment;

a half inch width and a quarter inch thick trimmer attachment;

a quarter inch width and a quarter inch thick trimmer attachment; and a beard trimmer length gauge attachment;

said battery powered base unit including a shaver housing having a battery compartment accessible through a removable end cap;

said battery compartment including a battery connector wired in series with an on/off switch and a DC drive motor;

said DC drive motor having an off-set output shaft with an attachment coupling end extending out of an attachment fitting end of said shaver housing;

said attachment fitting end having externally positioned base unit threads provided thereon;

each of said shaver attachments including a shaver head couplable to said off-set output shaft by an attachment slot formed into a bottom of said shaver head and a shaver attachment housing having an internally threaded base unit coupling end having internal shaver attachment threads that are companionate with said base unit threads;

each of said trimmer attachments including a trimmer assembly couplable to said off-set output shaft by an attachment slot formed into a bottom of said trimmer assembly and a trimmer attachment housing having an internally threaded base unit coupling end having internal trimmer attachment threads that are companionate with said base unit threads;

an exterior surface of said trimmer attachment housing having ridges extending outwardly therefrom for retaining said beard trimmer length gauge attachment when it is snap fit over said trimmer attachment housing;

said beard trimmer length gauge attachment having a gauge housing having a number of hair passage slots provided at a face contact end and an open trimmer coupling end sized and shaped to snap fit over said trimmer attachment housing.

* * * * *